United States Patent [19]

Pratt et al.

[11] Patent Number: 5,028,310

[45] Date of Patent: Jul. 2, 1991

[54] REDUCTION OF $SO_x$ IN REGENERATOR OFF GAS OF A FLUID CRACKING UNIT

[75] Inventors: Roy E. Pratt; David E. Self; Joseph C. Demeter, all of Port Neches, Tex.

[73] Assignee: Texaco Inc., White Plains, N.Y.

[21] Appl. No.: 433,103

[22] Filed: Nov. 8, 1989

[51] Int. Cl.[5] ..... C10G 11/18

[52] U.S. Cl. ..... 208/121; 208/113; 423/244; 502/517

[58] Field of Search ..... 208/113, 120, 121, 52 CT, 208/149; 502/517; 423/244

[56] References Cited

U.S. PATENT DOCUMENTS

| | | | |
|---|---|---|---|
| 2,987,486 | 6/1961 | Carr | 502/517 |
| 4,166,787 | 9/1979 | Blanton, Jr. et al. | 208/120 |
| 4,180,554 | 12/1979 | Goddin, Jr. et al. | 502/517 |
| 4,204,944 | 5/1980 | Flanders et al. | 208/124 |
| 4,238,317 | 12/1980 | Vasalos et al. | 208/113 |
| 4,240,899 | 12/1980 | Gladrow et al. | 208/120 |
| 4,259,176 | 3/1981 | Blanton et al. | 423/244 |
| 4,280,898 | 7/1981 | Tatterson et al. | 208/52 CT |
| 4,332,672 | 6/1982 | Blanton, Jr. et al. | 208/124 |
| 4,589,978 | 5/1986 | Green et al. | 208/113 |
| 4,613,428 | 9/1986 | Edison | 502/517 |
| 4,824,656 | 4/1989 | Rice et al. | 423/578 R |

*Primary Examiner*—Anthony McFarlane

*Attorney, Agent, or Firm*—Robert A. Kulason; James J. O'Loughlin; Carl G. Seutter

[57] ABSTRACT

$SO_x$ in regenerator off gas in a fluid cracking unit is decreased by providing in the regenerator bed, a metal grid bearing a layer of rare earth oxide.

7 Claims, 1 Drawing Sheet

FIG. 1
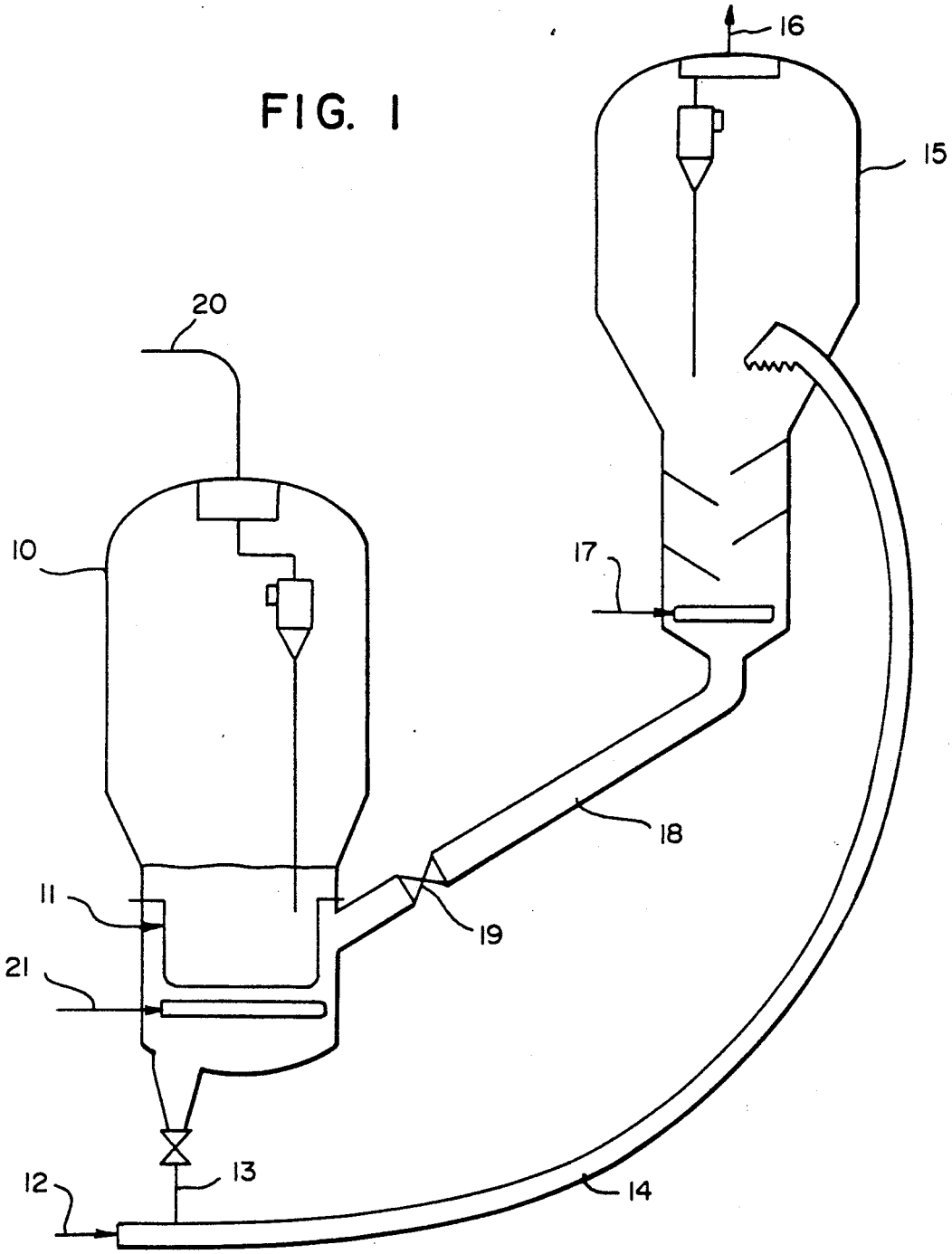
FIG. 2
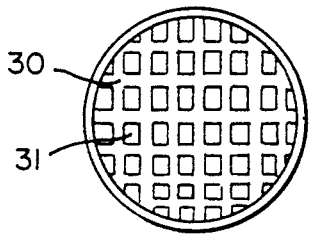
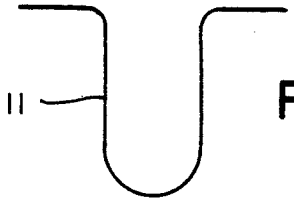
FIG. 3

REDUCTION OF $SO_x$ IN REGENERATOR OFF GAS OF A FLUID CRACKING UNIT

FIELD OF THE INVENTION

This invention relates to catalytic cracking. More particularly it relates to a method for decreasing the sulfur content of the gas emitted from a regenerator of a fluid catalytic cracking unit (FCCU).

BACKGROUND OF THE INVENTION

As is well known to those skilled in the art, it is desirable to increase the quantity of products boiling in the gasoline boiling range recovered from crude oil. This is commonly effected by catalytically cracking heavier cuts derived from crude oil distillation—typically a gas oil which may have an ibp of 400° F.–800° F., say 600° F., a 50% bp of 550° F.–975° F., say 800° F. and a 90% bp of 600° F.–1035° F., say 880° F.

As the supply of high quality (i.e. low sulfur-containing) crudes has decreased, there is an increasing tendency to utilize as charge to cracking units, hydrocarbon streams containing undesirably high content of sulfur.

When these sulfur-containing hydrocarbons are cracked, a portion of the sulfur content is released in the reactor as mercaptans or principally as hydrogen sulfide -due to the reducing conditions prevailing in the reactor. These sulfur-containing components are recovered with the reactor overhead and may be readily removed from the liquid condensate by various processes including Doctor treating etc.

A portion of the sulfur content of the charge hydrocarbon is deposited with the coke onto the catalyst particles. Clearly the sulfur content of the spent catalyst at this point depends on the sulfur content of the charge hydrocarbon; but it is not uncommon to find spent catalyst containing as much as 0.10 w % sulfur, and typically 0.01 w %–0.06 w % sulfur.

The spent catalyst, bearing coke plus sulfur, is passed to a regenerator wherein the carbon is burned off the catalyst to yield regenerated catalyst plus a gas containing oxides of carbon. Unfortunately this gas also contains oxides of sulfur—typically sulfur dioxide and sulfur trioxide, commonly referred to as $SO_x$. The $SO_x$ content of the regenerator off-gas may undesirably be as high as 2500 wppm, and when cracking a typical high-sulfur gas oil with sulfur content of 1.5 w %–3 w %, say 2.5 w %, it may commonly be 900 vppm–1800 vppm, say 1500 vppm.

Environmental considerations dictate that the sulfur content of the regenerator off-gas be decreased, preferably to below 500 vppm, say 100 vppm–300 vppm. There is a substantial body of prior art directed to this end. Illustrative of the many patents and literature on this subject may be noted U.S. Pat. Nos. 4,071,436; 4,432,890; WO 82/03225; and the article by Lowell et al *Selection of Metal Oxides for Removing $SO_2$ from Fuel Gas* I.E.C. (Proc. Des. Dev) Vol 10, No 3 (1971) p 384–390.

The prior art generally attempts to solve the problem by preparing a catalyst which includes components which it is hoped will decrease the sulfur content of the regenerator off gas to desired low levels.

It is an object of this invention to provide a novel method for reducing the sulfur content of the regenerator off gas of a catalytic cracking unit. Other objects will be apparent to those skilled in the art.

STATEMENT OF THE INVENTION

In accordance with certain of its aspects, this invention is directed to a method which comprises cracking a sulfur-containing charge hydrocarbon stream in contact with a fluidized bed of fluidized cracking catalyst in a cracking zone at cracking conditions including a temperature of 800° F.–1300° F. whereby at least a portion of the sulfur in said charge hydrocarbon stream is deposited with coke on said cracking catalyst to form spent catalyst containing coke and sulfur and a portion of the sulfur in said charge is converted to gaseous products;

passing said spent catalyst containing coke and sulfur from said cracking zone to a fluidized bed in a regeneration zone;

admitting oxygen-containing gas to said regeneration zone;

maintaining said regeneration zone at 1000° F.–1500° F. thereby regenerating said catalyst and forming a gas containing oxides of carbon and of sulfur;

contacting said gas containing oxides of carbon and sulfur with a metal surface bearing a layer of rare earth oxide, said metal surface being at least partially immersed in said fluidized bed in said regeneration zone, whereby at least a portion of the sulfur dioxide in said gas is converted to sulfur trioxide thereby forming gas containing increased quantities of sulfur trioxide;

maintaining said gas containing increased quantities of sulfur trioxide in contact with said cracking catalyst in said regeneration zone whereby at least a portion of said sulfur trioxide is adsorbed onto said cracking catalyst thereby forming a regenerated cracking catalyst bearing sulfur and a flue gas containing decreased quantities of sulfur;

passing said regenerated cracking catalyst bearing sulfur to said cracking zone wherein at least a portion of the sulfur on said regenerated catalyst is reduced to gaseous sulfur compounds including hydrogen sulfide, as the sulfur-containing hydrocarbon charge is cracked to form crackate; and withdrawing said crackate containing said gaseous sulfur compounds including hydrogen sulfide.

DESCRIPTION OF THE INVENTION

In practice of the process of this invention, the sulfur-containing charge hydrocarbon stream may be a heavy cut derived from crude distillation. Typically the charge may have an ibp of 400° F.–800° F., say 600, a 50% bp of 550° F.–975° F., say 800° F., and an ep of 700° F.–1150° F., say 1000° F. It may be a light gas oil, a heavy gas oil, a recycle gas oil, etc. It is a particular feature of the process of this invention that it finds use when the charge hydrocarbon stream contains 1 w %–4 w %, typically 2 w %–3 w %, say 2.5 w % sulfur (measured as S) as is typically the case when charging a straight run virgin gas oil derived from an Arabian crude oil containing 1.1 w %–3 w %, say 2.5 w % sulfur. (Sulfur content is determined by X-ray analysis).

Catalytic cracking is typically carried out in a fluidized bed in the presence of any of a wide variety of catalysts. Typical of such catalysts may be the Katalistiks Alpha 550 brand of rare earth exchanged ultrastable Y-zeolite containing 1.7 w % of rare earth oxides and having particle size distribution as follows:

TABLE

| Fresh Katalistiks Alpha 550 Catalyst | | |
|---|---|---|
| Microns | W % Fresh | W % Equilibrium |
| 0–20 | 0.8 | 0.6 |
| 20–40 | 7.7 | 8.0 |
| 40–80 | 32.5 | 37.6 |
| >80 | 59.0 | 53.8 |
| Average | 88.5 | 92 |

This catalyst also has the following properties:

TABLE

| Property | | Fresh Value | Equilibrium Value |
|---|---|---|---|
| Metal Analysis (ICAPS)* | | | |
| Ni | wppm | <100 | 2600 |
| V | wppm | <100 | 1100 |
| Fe | w % | 0.21 | 0.48 |
| Na | w % | 0.17 | 0.32 |
| Al | w % | 13.21 | 15.12 |
| Cr | wppm | <100 | <100 |
| La | w % | 0.25 | 0.49 |
| Ce | w % | 0.59 | 0.27 |
| Si | w % | 14.62 | 16.18 |
| Surface Area (Langmuir) $M^2/g$ | | | |
| Matrix | | 53 | 33 |
| Zeolite | | 248 | 126 |
| Total | | 302 | 160 |
| Surface Area (BET) $M^2/g$ | | | |
| Total | | 223 | 118 |
| Pore Volume cc/g | | 0.17 | 0.13 |
| Leco Carbon w % | | 0.05 | 0.31 |

*Inductively Coupled Argon Plasma Spectroscopy

Charge hydrocarbon (1000 parts) at 350° F.–700° F., say 600° F. is admixed with 4000–8000 parts, say 6000 parts of regenerated catalyst at 1000° F.–1500° F., say 1300° F. and passed to a reaction zone. Reaction zone conditions include temperature of 800° F.–1300° F., say 960° F. at 0–30 psig, say 25 psig. During the conversion of the hydrocarbon charge to lower boiling products, a portion of the sulfur in the charge is transferred to the catalyst and a portion is transferred to the gaseous lower boiling products.

Typically the charge hydrocarbon is converted to 400–900 parts, say 750 parts of lower boiling fractions including those boiling in the gasoline boiling range and lighter. When the charge hydrocarbon contains 2 w %–3 w %, say 2.5 w % sulfur, it is found that the lower boiling crackate may contain 2 w %–7 w %, say 2.7 w % sulfur -principally as hydrogen sulfide and mercaptans.

The spent catalyst leaving the reaction zone typically contain 0.45 w %–1.8 w %, say 0.9 w % carbon.

The spent catalyst (which as admitted to the reaction zone typically contained 0.001 w %–0.01 w %, say 0.004 w % sulfur) is also found to contain 0.01 w %–0.1 w %, say 0.03 w % sulfur. This catalyst (6000 parts) at 800° F.–1300° F., say 960° F. is withdrawn from the reaction zone and passed to the regeneration zone.

There is typically admitted to the lower portion of the regeneration zone 120–250 parts, say 183.4 parts of oxygen, preferably as air. During regeneration of the spent catalyst at 1000° F.–1500° F., say 1300° F. and 0–30 psig, say 25 psig, the carbon on the spent catalyst is burned to form regenerator off gas containing oxides of carbon principally carbon dioxide and carbon monoxide.

It is a feature of the process of this invention that during regeneration at 1000° F.–1500° F., say 1300° F., the sulfur contained in and on the spent catalyst is undesirably oxidized to oxides of sulfur ($SO_x$) principally sulfur dioxide and sulfur trioxide. Typically when operating a FCCU to which is charged a high sulfur charge containing 1.5 w %–3.0 w %, say 2.5 w % sulfur, the $SO_x$ content of the regenerator off-gas may be found to be as high as 900–1800 ppm, say 1500 ppm.

In practice of the process of this invention, the regenerator gases are contacted within the regenerator at 1000° F.–1500° F., say 1300° F. with a metal surface bearing a surface layer of rare earth oxide whereby at least a portion of the sulfur dioxide in the fuel gas is converted to sulfur trioxide. This latter actively reacts with the catalyst and is bonded thereto to a degree which is substantially in excess of the degree of bonding achieved if the sulfur were present as sulfur dioxide.

The metal surface bearing the surface layer of rare earth oxide should be at least partially immersed in the fluidized bed of catalyst in the regenerator.

It may for example be in the form of a metal grid bearing a surface layer of rare earth oxide or a heat exchanger, the outer surface of the metallic tubes thereof bearing a surface layer of rare earth oxide. The metal may be preferably stainless steel or inconel.

The rare earth metals which may be employed may include those of atomic number 21 (Scandium Sc), 39 (Yttrium Y), or 57–71 (Lanthanum La 57, Cerium Ce 58, Praeseodymium Pr 59, Neodymium Nd 60, Promethium Pm 61, Samarium Sm 62, Europium Eu 63, Gadolinium Gd 64, Terbium Tb 65, Dysprosium Dy 66, Holmium Ho 67, Erbium Er 68, Thullium Tm 69, Ytterbium Yb 70, and Lutetium Lu 71).

Although it may be possible to utilize the rare earths of the Actinide Series (atomic numbers of 90 and above), it is preferred to utilize those of the Lanthanide Series (atomic number 57–71).

The preferred rare earths include lanthanum and cerium.

The body bearing the metal surface which bears the surface layer of rare earth oxide may be in any one of a variety of configurations. It may for example be formed of an alloy of e.g. steel and a rare earth metal; in this instance, the active rare earth metal oxide which reacts with the $SO_x$ in the regenerator may be formed in situ on the surface of the body by oxidation in situ under the oxidizing conditions in the regenerator. It may for example be formed by electroplating or ion sputtering the rare earth metal onto the surface of the body of supporting metal. Other modes of forming the surface layer of rare earth oxide may include use of metal (e.g. stainless steel) bearing rare earth metals, the surface of which oxidizes, under the oxidizing conditions of the regenerator. Alternative methods of forming the surface rare earth metal on the base metal may include flame spraying, plasma coating, chemical vapor deposition, deposition by welding etc.

The metal structure bearing the coating or layer of rare earth oxides may be a regenerator heat exchanger or cooler (the shell side of which is sprayed with the rare earth metal solution followed by drying and calcining), a grid or rod or tube which is inserted into the bed of fluidized catalyst, etc.

It is preferred to utilize the rare earth metals as their water-soluble salts, typically nitrates in solution in water. The metal surface onto which the rare earth is to be deposited may preferably be the metal surface of the cooling coils of a heat exchanger (regenerator cooler) or alternatively the metal surface of a grid in the catalyst bed in the regenerator. The metal surface may be partially or wholly immersed in the fluid bed of the regenerator.

The grid or heat exchanger coils may be immersed or sprayed with the aqueous solution at 40° F.-200° F., say 60° F. and dried at 212°-300° F., say 250° F. for 2-10 hours, say 5 hours. This procedure may be repeated several (e.g. 3-4) times until a layer of rare earth compounds is built up.

The layer of dried salts may be calcined by heating to 1200° F.-1400° F., say 1300° F., for 2-10 hours, say 4 hours. During this time, the rare earth metal salts (typically the nitrates) decompose to yield a layer of rare earth metal oxide which is typically bonded to the metal surface. It may be found to be desirable to carry out the process by depositing the rare earth salt on the metal and then calcining followed by repeating both steps.

The treatment of the metal surface permits attainment of a tightly bonded layer of rare earth oxide. It is believed that the etching or chemical reaction of e.g. the nitrate ion yields a surface of the metal which provides a tight bonding of the rare earth oxides which is responsible for the life of the apparatus.

As a result of contact of the regenerator gas with the metal surface bearing the rare earth metal oxides, the sulfur content of the regenerator off-gas is lowered (from 1100 vppm-1500 vppm, say 1287 vppm) to a level of 470 vppm-640 vppm, say 582 vppm.

The regenerated catalyst (containing 0.006 w %-0.06 w %, say 0.02 w % sulfur) may then be withdrawn from the regenerator and passed, with fresh hydrocarbon feed, to the reactor.

Among the advantages of this invention may be noted the following:

(i) it permits attainment of regenerator off gas containing 50 %-65 % less $SO_x$ than is the case in the absence of the instant invention;

(ii) it permits operation to be effected without modifying the catalyst;

(iii) it permits operation to be effected by placing the active material in the regions where it can be most effective;

(iv) it permits operation to be more economical because there is a much smaller amount of active $SO_x$ removal component being used;

(v) it minimizes losses of rare earth which would occur as catalyst attrition losses;

(vi) it makes it possible to operate the sulfur removing portion of the apparatus independently of the other regenerator conditions. (i.e. If found desirable, it may be possible to independently adjust the temperature of the rare earth-bearing metal by heating or preferably cooling to attain improved results.)

DESCRIPTION OF THE DRAWING

FIG. 1 shows a schematic flow sheet of a process in which fluid catalytic cracking may be carried out.

FIG. 2 shows a schematic representation of a grid which may be utilized in practice of the process of this invention. In this Figure the metal surface bearing the rare earth metal oxides includes a metal grid 30 bearing a plurality of perforations 31.

FIG. 3 shows a schematic representation of a cooling coil which may be utilized in practice of the process of this invention.

DESCRIPTION OF SPECIFIC EMBODIMENTS

Example I

In this example which represents practice of the best mode presently known of carrying out the process of this invention, the rare earth metal is deposited on the surface of the regenerator heat exchanger 11. The shell side of latter, schematically shown in FIG. 3 of the drawing, is sprayed with a 10 w % aqueous solution of lanthanum nitrate. The solution is dried by heating with hot air at 400° F. for 4 hours and then calcined in air at 1300° F. for 4 hours. This procedure is repeated three times to form a layer of rare earth metal oxide on the inconel metal surface.

The so-treated heat exchanger is mounted within the regenerator 10 (at a position below the upper level of the fluidized bed of catalyst in the regenerator during regeneration) as schematically shown at 11 in FIG. 1; and it is used in fluid catalytic cracking operations as described below.

Charge high-sulfur gas oil (1000 parts) is characterized by the following properties:

TABLE

| Property | Value |
|---|---|
| ibp °F. | 418 |
| 50% bp °F. | 803 |
| ep °F. | 1076 |
| API | 24.1 |
| Sulfur Content w % | 2.67 |

Charge gas oil (1000 parts) at 497° F. is admitted at 12 and mixed with 6577 parts of regenerated catalyst at 1290° F. from line 13, which is a rare earth Ultrastable Y-zeolite cracking catalyst containing 0.04 w % carbon and 0.004 w % sulfur. The fluidized mix is passed through line 14 wherein catalytic conversion is effected at 959° F. to disengager vessel 15 to yield overhead crackate in line 16 characterized as follows:

TABLE

| Component | % of Fresh Feed |
|---|---|
| $H_2S$ | 1.43 WT % |
| $\leqq C_4$ | 21.50 WT % |
| $C_5$ −430° F. Gasoline | 55.03 VOL % |
| 430-670° F. LCGO | 17.87 VOL % |
| 670° F. + HCGO | 7.06 VOL % |

Catalyst is equilibrium Katalistiks Alpha 550 catalyst.

The sulfur content of this crackate (2.78 w %) includes hydrogen sulfide and mercaptans in addition to hydrocarbons.

Spent catalyst (6577 parts) is steam stripped with steam from line 17 and withdrawn through line 18. This spent catalyst contains 0.87 w % carbon and 0.025 w % sulfur. It is passed through control valve 19 to regenerator 10. Additional air may be admitted to regenerator 10 through line 21.

Regeneration is carried out at 1290° F. during which time carbon is burned off the spent catalyst to yield regenerator off gas containing 11.9 w % oxides of carbon.

The sulfur oxides formed in the regenerator contact the rare earth metal oxides on the metal surface 11 within the regenerator 10 at 1290° F. During this contact, the lower oxides, principally sulfur dioxide, may be oxidized to sulfur trioxide; and the latter is adsorbed by the regenerated catalyst and leaves the regenerator therewith.

The regenerator off gas leaving the regenerator 10 through line 20 may be found to contain only 582 vppm of oxides of sulfur ($SO_x$). Operation without the rare earth metal oxide-bearing metal surface of this invention would undesirably yield a regenerator off gas containing 1287 vppm of $SO_x$.

Example II*

In control Example II*, an FCCU is operated under "standard" conditions i.e. without using the technique of this invention. Charge is an Arabian Gas Oil having the following properties:

| Property | Value |
|---|---|
| ibp °F. | 464 |
| 50% bp °F. | 819 |
| ep °F. | 1038 |
| API | 22.5 |
| S content w % | 2.83 |

Catalyst is an equilibrium Katalistiks Alpha 550 catalyst as in Example I.

Catalytic cracking at 960° F. is effected to yield 75.2 v % conversion to 430° F.+ liquid product. Catalyst is found to contain 0.88 w % carbon and 0.024 w % sulfur.

Regeneration is carried out at 1314° F. with air (3.1 v % excess oxygen) to yield a regenerator off gas containing 1364 vppm sulfur (as oxides of sulfur $SO_x$).

It will thus be apparent that practice of the process of this invention permits attainment of a regenerator off gas desirably containing only (582/1364) 42.6% of the amount of $SO_x$ which is attained when the technique of the instant invention is not employed.

Although this invention has been illustrated by reference to specific embodiments, it will be apparent to those skilled in the art that various changes and modifications may be made which clearly fall within the scope of the invention.

What is claimed:

1. The method which comprises cracking a sulfur-containing charge hydrocarbon stream in contact with a fluidized bed of fluidized cracking catalyst in a cracking zone at cracking conditions including a temperature of 800° F.–1300° F. whereby at least a portion of the sulfur in said charge hydrocarbon stream is deposited with coke on said cracking catalyst to form spent catalyst containing coke and sulfur and a portion of the sulfur in said charge is converted to gaseous products;

passing said spent catalyst containing coke and sulfur from said cracking zone to a fluidized bed in a regeneration zone;

admitting oxygen-containing gas to said regeneration zone;

maintaining said regeneration zone at 1000° F.–1500° F. thereby regenerating said catalyst and forming a gas containing oxides of carbon and of sulfur;

contacting said gas containing oxides of carbon and sulfur with a metal surface bearing a layer consisting of rare earth oxide, said metal surface being at least partially immersed in said fluidized bed in said regeneration zone, whereby at least a portion of the sulfur dioxide in said gas is converted to sulfur trioxide thereby forming gas containing increased quantities of sulfur trioxide;

maintaining said gas containing increased quantities of sulfur trioxide in contact with said cracking catalyst in said regeneration zone whereby at least a portion of said sulfur trioxide is adsorbed onto said cracking catalyst thereby forming a regenerated cracking catalyst bearing sulfur and a flue gas containing decreased quantities of sulfur;

passing said regenerated cracking catalyst bearing sulfur to said cracking zone wherein at least a portion of the sulfur on said regenerated catalyst is reduced to gaseous sulfur compounds including hydrogen sulfide, as the sulfur-containing hydrocarbon charge is cracked to form crackate; and withdrawing said crackate containing said gaseous sulfur compounds including hydrogen sulfide.

2. The method claimed in claim 1 wherein said rare earth is lanthanum.

3. The method claimed in claim 1 wherein said rare earth is deposited on said metal surface as a water-soluble salt in aqueous solution which is dried and then calcined.

4. The method claimed in claim 1 wherein said rare earth is deposited on said metal surface by contact with an aqueous solution of a water-soluble rare earth salt including lanthanum which is dried at 212° F.–300° F. for 2–10 hours and thereafter calcined at 1200° F.–1400° F. for 2–10 hours.

5. The method claimed in claim 1 wherein said metal surface is totally immersed in the fluidized bed of catalyst in said regeneration zone.

6. The method which comprises cracking a sulfur-containing charge hydrocarbon stream in contact with a fluidized bed of fluidized cracking catalyst in a cracking zone at cracking conditions including a temperature of 800° F.–1300° F. whereby at least a portion of the sulfur in said charge hydrocarbon stream is deposited with coke on said cracking catalyst to form spent catalyst containing coke and sulfur and a portion of the sulfur in said charge is converted to gaseous products;

passing said spent catalyst containing coke and sulfur from said cracking zone to a fluidized bed in a regeneration zone;

admitting oxygen-containing gas to said regeneration zone;

maintaining said regeneration zone at 1000° F.–1500° F. thereby regenerating said catalyst and forming a gas containing oxides of carbon and of a sulfur;

contacting said gas containing oxides of carbon and sulfur with a grid having a metal surface bearing a layer consisting essentially of rare earth oxide, said metal surface being at least partially immersed in said fluidized bed in said regeneration zone, whereby at least a portion of the sulfur dioxide in said gas is converted to sulfur trioxide thereby forming gas containing increased quantities of sulfur trioxide;

maintaining said gas containing increased quantities of sulfur trioxide in contact with said cracking catalyst in said regeneration zone whereby at least a portion of said sulfur trioxide is adsorbed onto said cracking catalyst thereby forming a regenerated cracking catalyst bearing sulfur and a flue gas containing decreased quantities of sulfur;

passing said regenerated cracking catalyst bearing sulfur to said cracking zone wherein at least a portion of the sulfur on said regenerated catalyst is reduced to gaseous sulfur compounds including hydrogen sulfide, as the sulfur-containing hydrocarbon charge is cracked form crackate; and withdrawing said crackate containing said gaseous sulfur compounds including hydrogen sulfide.

7. The method which comprises cracking a sulfur-containing charge hydrocarbon stream in contact with a fluidized bed of fluidized cracking catalyst in a cracking zone at cracking conditions including a temperature of 800° F.–1300° F. whereby at least a portion of the sulfur in said charge hydrocarbon stream is deposited with coke on said cracking catalyst to form spent catalyst containing coke and sulfur and a portion of the sulfur in said charge is converted to gaseous products;

passing said spent catalyst containing coke and sulfur from said cracking zone to a fluidized bed in a regeneration zone;

admitting oxygen-containing gas to said regeneration zone;

maintaining said regeneration zone at 1000° F.–1500° F. thereby regenerating said catalyst and forming a gas containing oxides of carbon and of a sulfur;

contacting said gas containing oxides of carbon and sulfur with a coil of a heat exchanger in the catalyst bed, said coil having a metal surface bearing a layer consisting essentially of rare earth oxide, said metal surface being at least partially immersed in said fluidized bed in said regeneration zone, whereby at least a portion of the sulfur dioxide in said gas is converted to sulfur trioxide thereby forming gas containing increased quantities of sulfur trioxide;

maintaining said gas containing increased quantities of sulfur trioxide in contact with said cracking catalyst in said regeneration zone whereby at least a portion of said sulfur trioxide in adsorbed onto said cracking catalyst thereby forming a regenerated cracking catalyst bearing sulfur and a flue gas containing decreased quantities of sulfur;

passing said regenerated cracking catalyst bearing sulfur to said cracking zone wherein at least a portion of the sulfur on said regenerated catalyst is reduced to gaseous sulfur compounds including hydrogen sulfide, as the sulfur-containing hydrocarbon charge is cracked form crackate; and withdrawing said crackate containing said gaseous sulfur compounds including hydrogen sulfide.

* * * * *